US005611288A

United States Patent [19]

Dallman et al.

[11] Patent Number: 5,611,288

[45] Date of Patent: Mar. 18, 1997

[54] MODULAR TRANSPORT SYSTEM FOR AN AUTOMATIC TELLER MACHINE

[75] Inventors: Ernest R. Dallman, 9200 Fanchon Dr., Zionsville, Ind. 46077; Franklin W. Wehr, Indianapolis, Ind.

[73] Assignee: Ernest R. Dallman, Zionsville, Ind.

[21] Appl. No.: 501,189

[22] Filed: Jul. 11, 1995

Related U.S. Application Data

[63] Continuation of Ser. No. 121,790, Sep. 15, 1993, Pat. No. 5,440,999, which is a continuation-in-part of Ser. No. 954,001, Sep. 29, 1992, Pat. No. 5,299,511, which is a continuation-in-part of Ser. No. 892,758, Jun. 3, 1992, abandoned.

[51] Int. Cl.[6] ..... E05G 1/00

[52] U.S. Cl. ..... 109/50; 109/24.1; 312/331; 312/249.1

[58] Field of Search ..... 312/331, 319.8, 312/350, 249.1, 249.8, 249.9, 330.1, 334.27, 334.36, 311; 248/678, 346; 109/2, 24.1, 45, 50, 53, 58

[56] References Cited

U.S. PATENT DOCUMENTS

| | | | |
|---|---|---|---|
| Re. 22,431 | 2/1944 | Sloan, Jr. . | |
| 2,185,763 | 1/1940 | De Lisle . | |
| 2,590,592 | 3/1952 | Wittemann . | |
| 3,091,816 | 6/1963 | Wetzel . | |
| 3,728,017 | 4/1973 | Schmidlin | 312/350 |
| 3,897,901 | 8/1975 | Grosswiller, Jr. et al. . | |
| 4,192,544 | 3/1980 | Patterson . | |
| 4,399,755 | 8/1983 | Wiedmann . | |
| 4,457,492 | 7/1984 | Lahti . | |
| 4,497,261 | 2/1985 | Ferris et al. . | |
| 4,513,670 | 4/1985 | Berman . | |
| 4,557,352 | 12/1985 | Tschappat, Jr. . | |
| 4,558,650 | 12/1985 | Berman . | |
| 4,577,562 | 3/1986 | Berman . | |
| 4,603,643 | 8/1986 | Couvrette . | |
| 4,649,832 | 3/1987 | Hain et al. . | |
| 4,681,044 | 7/1987 | Dallman . | |
| 4,813,475 | 3/1989 | Couvrette . | |
| 4,856,437 | 8/1989 | Trucksess . | |
| 5,036,779 | 8/1991 | Capraro . | |
| 5,052,878 | 10/1991 | Brockhaus | 312/350 |
| 5,215,363 | 6/1993 | Warwick . | |
| 5,222,445 | 6/1993 | Capraro . | |
| 5,275,064 | 1/1994 | Hobbs | 312/331 |

FOREIGN PATENT DOCUMENTS

| | | |
|---|---|---|
| 3-50694 | 5/1991 | Japan . |

*Primary Examiner*—Flemming Saether
*Attorney, Agent, or Firm*—Barnes & Thornburg

[57] ABSTRACT

An apparatus is provided for moving an ATM relative to a wall between a retracted position and an extended position. The apparatus includes a base, a gear, and a motor coupled to the base for rotating the gear relative to the base. The apparatus also includes a mechanism coupled to the ATM for engaging the gear to move the ATM between its retracted position and its extended position, and a bearing positioned between the base and the ATM to facilitate movement of the ATM relative to the base. The apparatus also includes a foldable floor panel coupled to the ATM. The foldable floor panel is configured to move from an unfolded, generally planar orientation when the ATM is in its extended position to a folded, generally upright position when the ATM is in its retracted position.

12 Claims, 13 Drawing Sheets

MODULAR TRANSPORT SYSTEM FOR AN AUTOMATIC TELLER MACHINE

This is a continuation application of co-pending application Ser. No. 08/121,790 filed Sep. 15, 1993 now U.S. Pat. No. 5,440,999 issued Aug. 15, 1995 which is a continuation-in-part of U.S. application 07/954,001, filed Sep. 29, 1992 now U.S. Pat. No. 5,299,511 issued Apr. 4, 1994 which is a continuation-in-part of U.S. application Ser. No. 07/892, 758, filed Jun. 3, 1992 now abandoned.

BACKGROUND AND SUMMARY OF THE INVENTION

The present invention relates to automatic teller machine modules, and particularly to movable automatic teller machine (hereinafter "ATM") modules. More particularly, the present invention relates to an improved apparatus for moving an automatic teller machine module from a retracted position to an extended position to facilitate servicing of the ATM.

Conventional ATMs are increasingly being placed in isolated locations such as in parking lots, and the like. The ATM must be secure to prevent unauthorized entry because a large amount of money is contained inside the ATM. The operator panel for the ATM is located in a wall. The wall may be the wall of any structure.

Because ATMs are normally used by drive-up customers in automobiles, the wall containing the operator panel must be designed to allow the automobile to approach the operator panel as closely as possible. This is normally accomplished designating a drive-through lane and by positioning the wall parallel to this lane, and as close to the lane as possible.

ATMs often include an access door to an interior region behind the wall to permit servicing of the ATM. The access door must have room to open to permit access to the interior region behind the wall for servicing or for reloading the ATM with currency. The access door is typically located directly opposite the operator panel of the ATM. It is advantageous to mount the ATM in a movable cabinet to permit the ATM to be extended, thereby permitting the access door to open. Providing a movable cabinet maintains the overall dimension of the interior region to a minimum. The cabinet is moved from a fully retracted position inside the wall to an extended position to provide access to the interior region behind the wall.

Some conventional drive mechanisms for movable ATM modules provide tracks or rails for moving the ATM out of a structure. The rails provide external support for the ATM module as the ATM module moves to its extended position. The rails are often permanently affixed to the pavement in the drive-through lane. Typically, the ATMs are mounted in carriages that roll on wheels along the rails. See, for example, U.S. Pat. No. 4,557,352. Problems exist with external rail drive mechanisms. The external rails affixed to the pavement are subject to wear and tear and damage from vehicles, as well as rust and corrosion from being exposed to the environment. Conventional drive mechanisms for moving ATM modules include electric motors with drive belts for driving wheels or a hand crank which operates chain and sprocket drive mechanisms.

One object of the present invention is to provide a simple and effective mechanism for extending an ATM which has few moving parts and requires little maintenance and upkeep.

Another object of the present invention is to provide a drive mechanism for extending and retracting an ATM which provides improvements over conventional chain and sprocket drive mechanisms.

Another object of the present invention is to provide a modular ATM with extension capability that can be located in the wall of any structure and that is easily installed in the wall of existing structures to replace a preexisting ATM.

Yet another object of the present invention is to eliminate the need for external tracks and rails associated with the extension mechanism and provide an integral means for supporting the ATM in the extended position.

According to one aspect of the present invention, an apparatus is provided for moving an ATM relative to a wall between a retracted position and an extended position. The apparatus includes a base, a gear, and means coupled to the base for rotating the gear relative to the base. The apparatus also includes means coupled to the ATM for engaging the gear to move the ATM between its retracted position and its extended position, and a bearing positioned between the base and the ATM to facilitate movement Of the ATM relative to the base.

In the illustrated embodiment, the gear has a plurality of teeth, and the engaging means includes a rack coupled to the ATM and configured to mesh with the teeth of the gear. The means for rotating the gear includes an electric motor coupled to the gear for rotating the gear relative to the base.

According to another aspect of the present invention, an apparatus is provided for moving an ATM relative to a wall between a retracted position and an extended position. The apparatus includes a base, means for moving the ATM relative to the base, and a foldable floor panel coupled to the ATM. The foldable floor panel is configured t move from an unfolded, generally planar orientation when the ATM is in its extended position to a folded, generally upright position when the ATM is in its retracted position.

In the illustrated embodiment, the foldable floor panel includes a front section having first and second ends and a rear section having first and second ends. The foldable floor panel also includes a first hinge for pivotably coupling the first end of the front section to the ATM, and a second hinge for pivotably coupling the second end of the front section to the first end of the rear section.

The apparatus includes means for automatically lifting the foldable floor panel as the ATM moves from its extended position to its retracted position. In the illustrated embodiment, the lifting means includes a cam pivotably coupled to the base. The cam is configured to engage a center portion of the foldable floor panel adjacent the second hinge to lift the center portion of the foldable floor panel upwardly away from the base as the ATM moves from its extended position to its retracted position.

The apparatus also includes a support rail coupled to the base for supporting the second end of the rear section. The support rail includes a trough section for receiving the second end of the rear section when the floor panel is in its folded, generally upright orientation and a ledge for supporting the second end of the rear section when the foldable floor panel is in its unfolded, generally planar orientation.

According to yet another aspect of the present invention, an apparatus is provided for moving an ATM relative to a wall between a retracted position and an extended position. The apparatus includes a base plate, a movable floor located above the base plate and configured to slide relative to the base plate, and a bearing positioned between the base plate and the movable floor to facilitate movement of the movable floor relative to the base plate. The apparatus includes means for coupling the movable floor to the ATM so that the ATM moves with the movable floor, and means for moving movable floor and the ATM relative to the base plate to move the ATM between its retracted position and its extended position.

Additional objects, features, and advantages of the invention will become apparent to those skilled in the art upon consideration of the following detailed description of a preferred embodiment exemplifying the best mode of carrying out the invention as present perceived.

BRIEF DESCRIPTION OF THE DRAWINGS

The detailed description particularly refers to the accompanying figures in which.

DETAILED DESCRIPTION OF THE DRAWING

FIGS. 1–5 show embodiments of the present invention which include powered drive mechanisms for moving an ATM module. The embodiment shown in FIGS. 6–10 includes a manually operated mechanism for moving an ATM module. Like elements have been identified with the same reference number in all figures.

Figure 1:
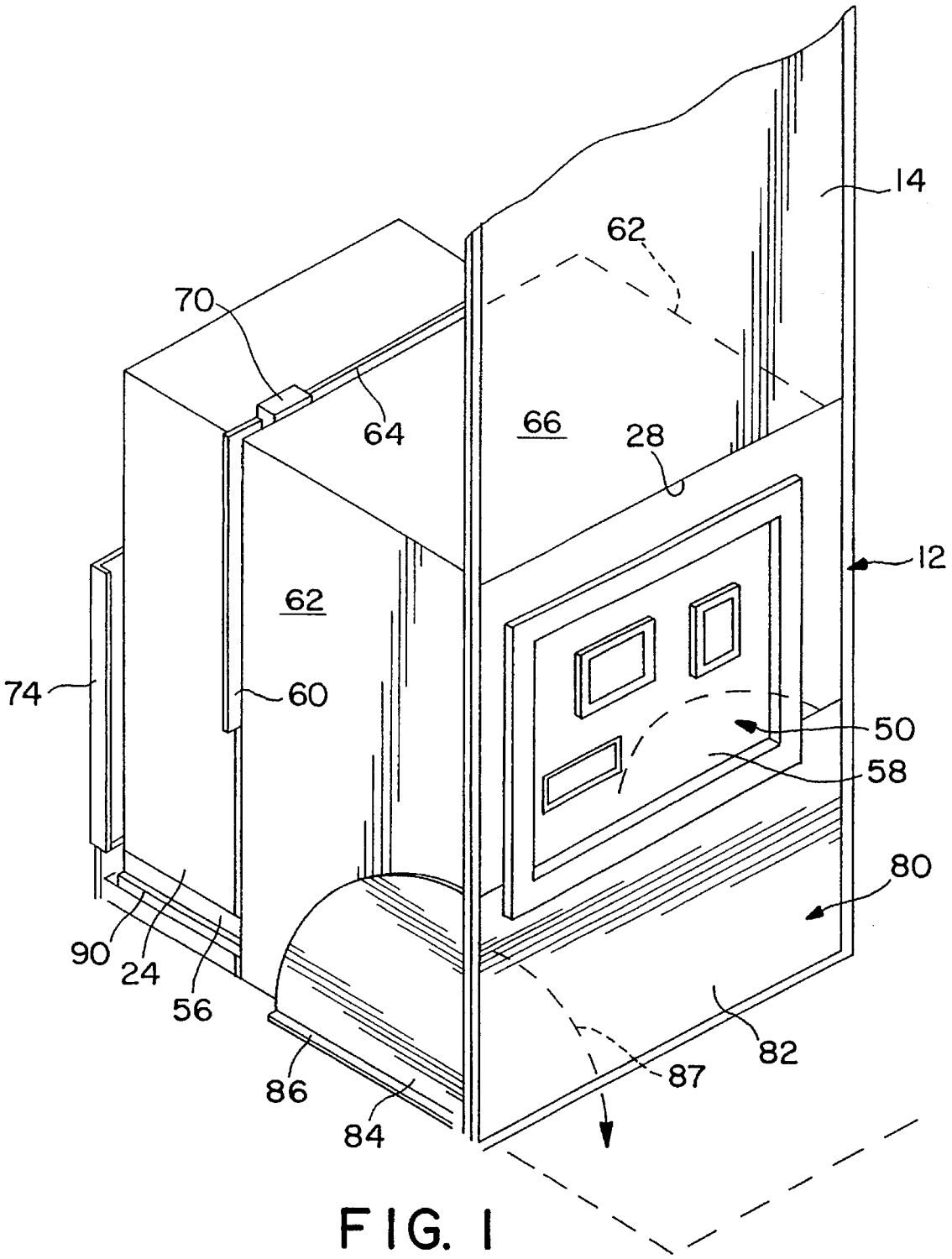
FIG. 1 is a perspective view partially broken away to illustrate an extendable ATM module of the present invention in a retracted position in a wall.

Referring now to FIG. 1, a wall 14 is illustrated within which an ATM module 12 is located. Wall 14 is formed to include an aperture 28 through which the ATM module 12 extends. It will be understood that the ATM module 12 can be installed in any wall of any structure regardless of the size, shape, or type of such structure.

ATM module 12 includes an ATM 50 mounted inside a movable cabinet 24. ATM 50 is mounted so that an operator panel 58 of ATM 50 is positioned to be substantially coplanar with wall 14 when ATM module 12 is in its retracted position illustrated in FIG. 1.

Cabinet 24 is mounted on a platform 56 which is coupled to a movable floor 90. Side flanges 60 extend along a portion of sidewalls 62 of cabinet 24. Continuous with side flanges 60, an upper flange 64 extends across top wall 66 of cabinet 24.

For the embodiments of the invention shown in FIGS. 1–5, a limit switch 70 is mounted to upper flange 64. Limit switch 70 is positioned to contact wall 14 as ATM module 12 moves from its retracted position to its extended position. When contact between limit switch 70 and wall 14 is made, limit switch 70 causes the extension mechanism to stop forward movement of the ATM module 12.

Figure 2:
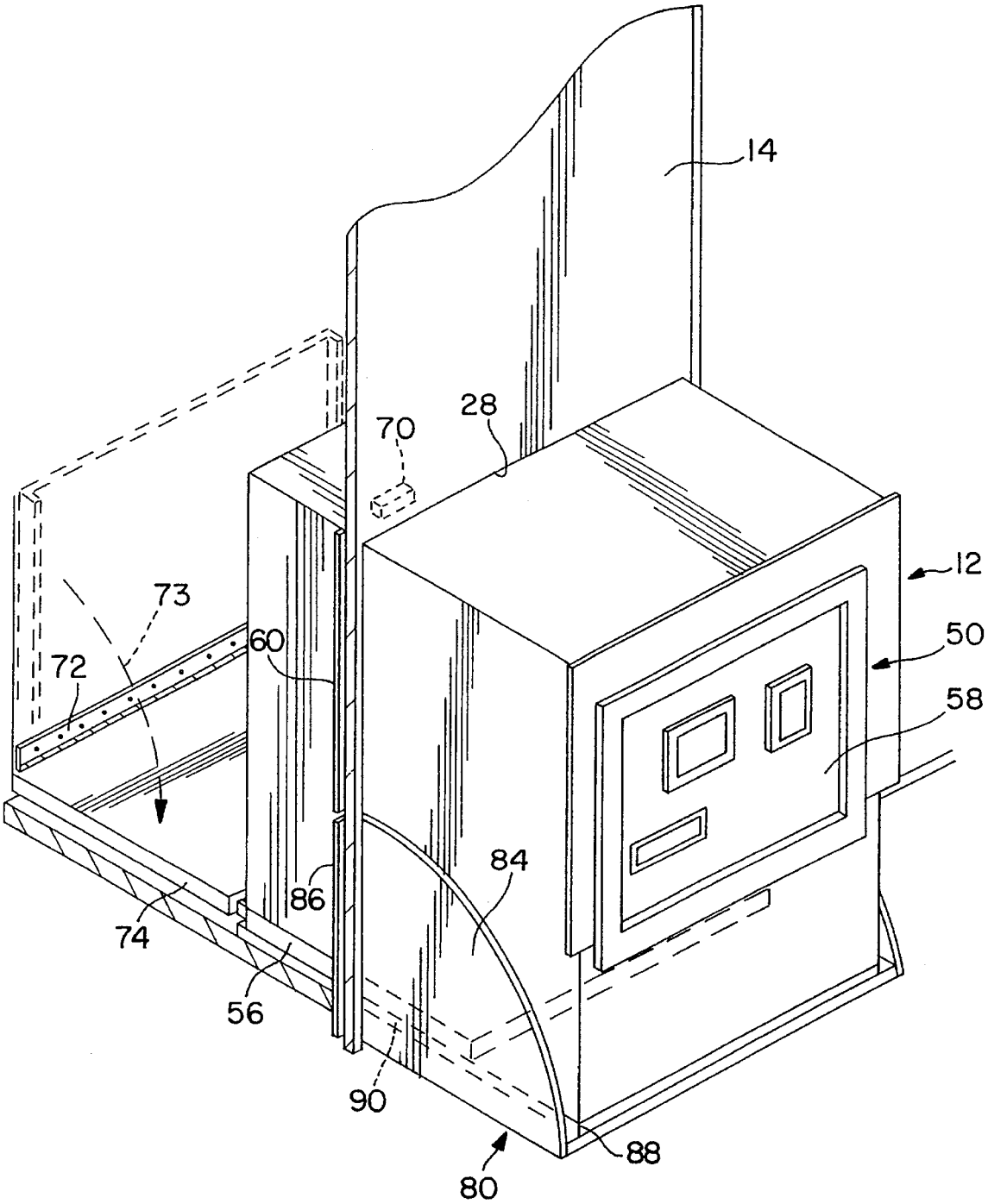
FIG. 2 is a perspective similar to FIG. 1 illustrating the ATM module in an extended position.

A floor cover plate 74 is connected to a hinge 72 (shown in FIG. 2). Hinge 72 is connected to any suitable support. Floor cover plate 74 pivots about hinge 72 between an upright stowed position illustrated in FIG. 1 (dotted in FIG. 2), and a use position, as illustrated in FIG. 2. Movement of floor cover 74 is illustrated by arrow 73 in FIG. 2. When ATM module 12 is moved to its extended position illustrated in FIG. 2, floor cover plate 74 pivots in the direction of arrow 73 to its use position, whereupon floor cover plate 74 occupies substantially the same space vacated by platform 56.

For the embodiments of FIGS. 1–5, a cabinet support member 80 rotates between a stowed position illustrated in FIG. 1, and a use position illustrated in FIG. 2 as ATM module 12 moves from its retracted position to its extended position. In the stowed position, a support plate 82 of support member 80 forms a portion of wall 14 under operator panel 58 of ATM 50. A pair of quarter-round sidewalls 84 are perpendicular to, and extend away from, support plate 82 so as to be located behind wall 14 when support member 80 is in its stowed position. An inner surface 88 of support plate 82 is covered with a sheet of very high molecular weight polymer material. The polymer material advantageously forms a bearing surface for sliding contact with movable floor 90 when ATM module 12 is extended.

Flanges 86 are formed on quarter-round sidewalls 84 to extend outwardly away from ATM module 12. Flanges 86 are positioned to contact wall 14 when cabinet support member 80 is fully rotated to its use position as illustrated by arrow 87 in FIG. 1. When ATM module 12 is in its fully extended position, flanges 86 cooperate with side flanges 60 and upper flange 64 to form a substantially continuous seal around the sides and top of ATM aperture 28. Flanges 86 also serve to limit the amount of travel of support plate 82 and assist support plate 82 in supporting ATM module 12.

Figure 3:
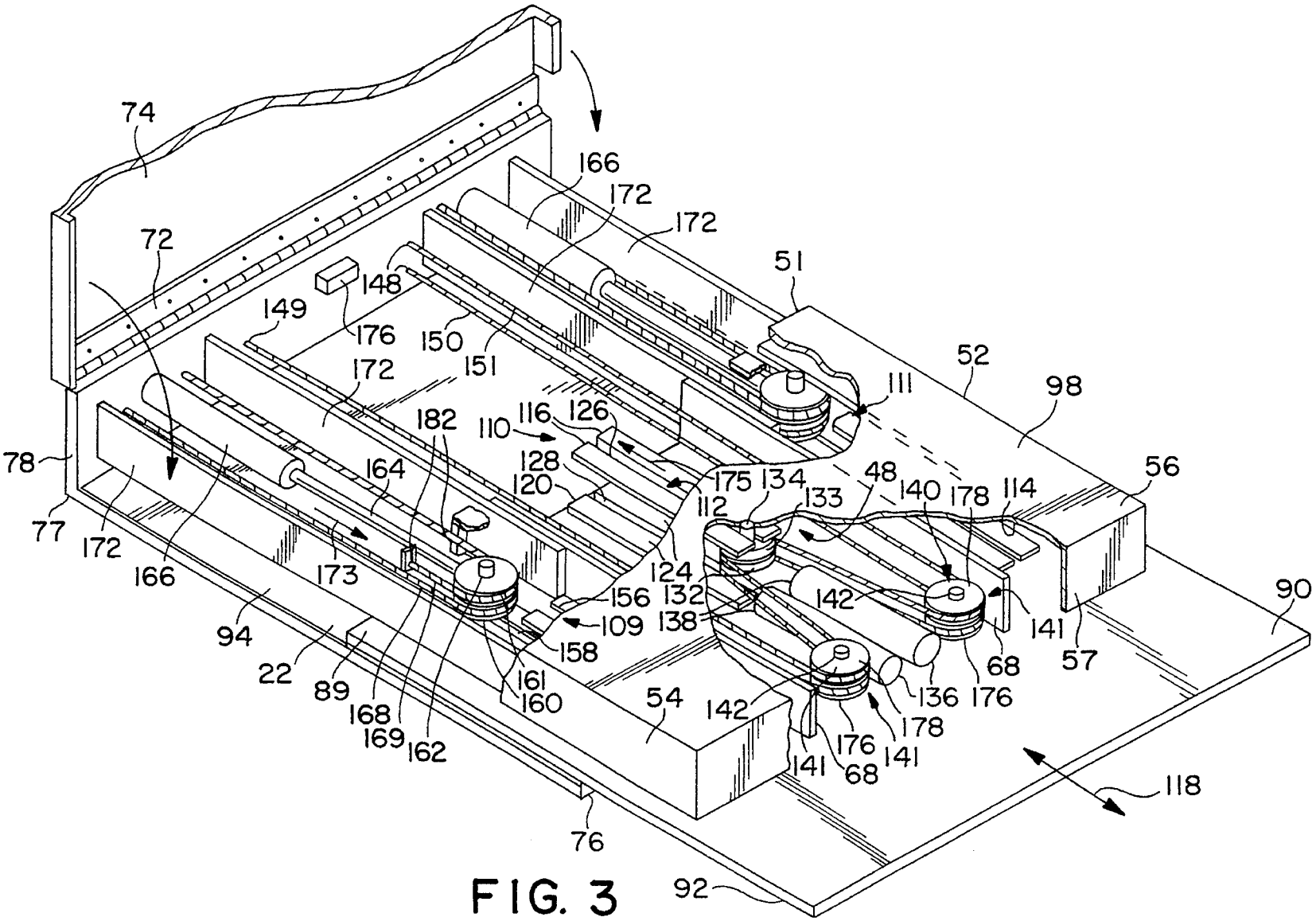
FIG. 3 is a perspective view, partially broken away, illustrating a first embodiment of an ATM module extension and retraction mechanism of the present invention.

As illustrated in FIG. 3, one embodiment of an extending and retracting means includes a platform 56 which is attached to movable floor 90, forming an interior region 48. Movable floor 90 is slidably positioned on a stationary base plate 22. Base plate 22 has a front end 76 and a back end 77. A back plate 78 extends along back end 77 and projects vertically therefrom. Platform 56 is formed to include four sidewalls 51, 52, 53, 54 and a top 98, with sidewall 51 extending along back end 89 of movable floor 90. A pair of vertically oriented platform support members 68 are disposed between movable floor 90 and top 98 of platform 56. Platform support members 68 are disposed in a parallel, spaced-apart relation extending between sidewall 51 and sidewall 53, thereby extending in the direction of motion 118 of ATM module 12.

One sheet of very high molecular weight polymer material is attached to bottom surface 92 of movable floor 90, and another sheet of very high molecular weight polymer material is attached to upper surface 94 of base plate 22. The sheets of polymer provide bearing surfaces on movable floor 90 and base plate 22. Similar bearing surfaces are formed between bottom surface 92 of movable floor 90 and inner surface 88 of support plate 82 when ATM module 12 is extended. Illustratively, the very high molecular weight polymer material is TIVAR 100 available from Shamrock Plastics and Rubber in Indianapolis, Ind. Although reference is made to sheets of polymer that are attached to various surfaces, the polymer could be applied in other ways, such as by bonding or spraying. The interfacing sheets of very high molecular weight polymer material provide a very low coefficient of friction to facilitate movement of ATM module 12. A coat of silicone gel is preferably spread over the interfacing sheets of very high molecular weight polymer material.

Three substantially identical guide channels 109, 110, 111 are formed to lie within interior region 48 of platform 56. Although only one channel will be described in detail, it is understood that the description generally applies to all three channels 109, 110, 111.

Retraction pulley guide channel 110 includes an upper guide channel 112 and a lower guide channel 120. Guide channel 110 includes an upper pair of parallel, spaced-apart members 116 attached to bottom surface 114 of platform top 98 and disposed between support members 68. Members 116 define a slot 126 therebetween. Guide channel 110 further includes a pair of parallel, spaced-apart members 124 forming a slot 128 therebetween. Members 124 are attached to movable floor 90 so as to be in vertical alignment with upper members 116. Together, slots 126 and 128 define a vertically oriented, parallel plane extending along the direction of motion 118 of ATM module 12.

A pair of primary retraction pulleys 132, 133 are positioned in axially spaced-apart relation along a vertical axle 134 extending between slots 126, 128. Axle 134 is slidably movable in slots 126, 128. A pair of parallel, spaced-apart retraction piston rods 138 are coupled to axle 134 between pulleys 132. A pair of conventional hydraulic cylinders 136 are fixed to movable floor 90. Cylinders 136 include internal pistons which are coupled to piston rods 138 to drive piston rods 138 in a conventional fashion. Movement of piston rods 138 causes pulleys 132, 133 to move back and forth in slots 126 and 128.

Two sets of secondary retraction pulleys 140, 141 are disposed respectively between retraction cylinders 136 and support members 68. Each set includes a pair of pulleys 176, 178 axially spaced-apart along a vertical axle 142 extending from movable floor 90 to top 98 of platform 56. Axles 142 are fixed in position to prohibit any translational movement of sets of pulleys 140, 141 relative to movable floor 90 or platform 56. Primary retraction pulleys 132, 133 and secondary retraction pulleys 140, 141 are positioned relative to each other in a triangular relation.

Two retraction cables 150, 151 are provided for moving floor 90 from its extended position to its retracted position. Opposite ends 148, 149 of retraction cables 150, 151 are attached to back plate 78. Cables 150, 151 pass around retraction pulleys 132 133, 140, 141 as illustrated in FIG. 3. Bottom retraction cable 150 passes sequentially around the lower pulley 176 of one set 140 of secondary retraction pulleys, the lower pulley 132 of primary retraction pulleys, and the lower pulley 176 of set 141 of secondary retraction pulleys. Top retraction cable 151 follows the same path as bottom retraction cable 150, but is vertically spaced-apart from cable 150 so as to pass around upper pulley 178 of secondary pulleys 140, around upper pulley 133 of primary pulleys, and around upper pulley 178 of secondary pulleys 141.

The extension mechanism comprises two substantially identical systems. Reference will be made to one of the systems, but it will be understood that the description applies to both.

Extension pulley guide channels 109, 111 are positioned in parallel spaced-apart relation to each other on opposite sides of retraction pulley guide channel 110. Guide channel 109 includes guide slots 156 and 158 formed in the same fashion as guide slots 126, 128. A pair of extension pulleys 160, 161 are positioned in spaced-apart relation along a vertical axle 162 that extends between slot 156 and slot 158 formed in guide channel 109. Axle 162 is slidably movable along slots 156, 158.

An extension piston rod 164 is coupled to axle 162 between pulleys 160, 161. A first end of a conventional hydraulic cylinder 166 is fixed to back plate 78 and a piston inside cylinder 166 is coupled to piston rod 164 to drive piston rod 164 back and forth in a conventional fashion. Movement of piston rod 164 causes extension pulleys 160, 161 to move along guide slots 156, 158.

A pair of vertically spaced-apart, mirror image extension cables 168, 169 extend from back plate 78 around extension pulleys 160, 161 and are connected at attachment points 182 to sidewall 51 of platform 56. First cable 168 passes around lower pulley 160 in one direction and second cable 169 passes around upper pulley 161 in the opposite direction. Advantageously, running the cables in opposite directions eliminates any non-axial loads on extension cylinder 166 and piston rod 164.

Cantilevered supports 172 are attached to back plate 78 and extend horizontally therefrom. Supports 172 are spaced apart from base plate 22 by a distance substantially equal to the thickness of movable floor 90. The height of supports 172 is substantially equal to the height of sidewalls 51, 52, 53, 54 of platform 56. Supports 172 are positioned in parallel spaced-apart relation so as to bracket extension cylinders 166. Supports 172 pass through openings formed in sidewall 51 of platform 56, thereby allowing movable floor 90 and top 98 of platform 56 to slide under and over supports 172, respectively.

A limit switch 176 is attached to back plate 78. Switch 176 is positioned to sense the proximity of platform 56, and hence ATM module 12, and cut off pressure to retraction cylinders 136, thereby stopping movement of ATM module 12.

Floor cover plate 74 is attached to hinge 72, which in turn is attached to back plate 78. Hinge 72 is positioned to allow cover plate 74 to assume a vertical or upright, stowed position illustrated in FIG. 1, or a horizontal use position, as illustrated in FIG. 2. In the use position, cover plate 74 rests on top of supports 172, thereby covering the extension and retraction mechanisms and keeping dirt and grime off of the layer of very high molecular weight polymer attached to base plate 22.

In operation, a technician extends ATM module 12 by using a conventional electrically controlled hydraulic system. The electrical control releases hydraulic pressure supplied to retraction cylinders 136 and supplies fluid pressure to extension cylinders 166, thereby driving piston rods 164 forward. Piston rods 164 push extension pulleys 160, applying tension to cables 168 in the process. Cables 168, in turn, move sidewall 51 in the direction of arrow 173. Platform 56 is attached to movable floor 90. Therefore, movement of platform 56 causes movable floor 90 to slide over base plate 22.

As movable floor 90 moves forward, it engages inside surface 88 of support plate 82, thereby causing support member 80 to pivot in the direction of arrow 87 in FIG. 1 to its horizontal use position illustrated in FIG. 2. As support member 80 approaches the use position, sidewall flanges 86, side flanges 60, and upper flange 64 approach the inside surface of wall 14.

As ATM module continues to extend, limit switches 70 on upper flange 64 contact the inside surface of wall 14 and causes pressure to be shut off to extension cylinders 166, thereby stopping the extension of ATM module 12. When ATM module 12 is fully extended, sidewall flanges 86 contact wall 14, providing a positive limit on the amount of travel of support member 80 in order to ensure adequate support. When ATM module 12 is fully extended, sidewall flanges 86 cooperate with side flanges 60 and upper flange 64 to form a substantially continuous seal around the top and sides of ATM aperture 28. Support member 80 advantageously restricts the access of contaminants to the bearing surfaces between movable floor 90 and inside surface 88 of support plate 82.

When ATM module 12 has been fully extended, there is sufficient room in the space vacated by ATM module 12 for floor cover plate 74 to be lowered into its use position covering extension cylinders 166. In the use position, cover plate 74 allows the technician to stand on cover plate 74 behind ATM module 12 to perform maintenance and repair or resupply money without damaging the extension and retraction mechanisms.

When the technician is finished and ready to leave, he lifts floor cover plate 74 out of the way into its upright stowed position and actuates a retraction switch which causes the hydraulic pressure in extension cylinders 166 to be released. At the same time, pressure is supplied to retraction cylinders 136 to drive retraction piston rods 138 forward. As retraction piston rods 138 are driven forward, extension piston rods 164 of cylinders 166 are pushed back to return to the original retracted position.

Piston rods 138 push primary retraction pulleys 132, 133 in the direction of arrow 175, thereby applying tension to retraction cables 150, 151. Cables 150, 151 pull secondary retraction pulleys 140, 141 in the direction of arrow 175. Because pulleys 140, 141 are attached to movable floor 90 and platform 56, the pulleys 140, 141 move movable floor 90 and platform 56 in the direction of arrow 175, thereby retracting ATM module 12.

As ATM module 12 retracts, movable floor 90 moves, allowing support plate 82 to rise to provide a portion of front wall 14. When module 12 approaches full retraction, limit switch 176 on back plate 78 contacts sidewall 51 of platform 56 and causes the hydraulic pressure to retraction cylinders 136 to be shut off, thereby stopping retraction.

Figure 4:
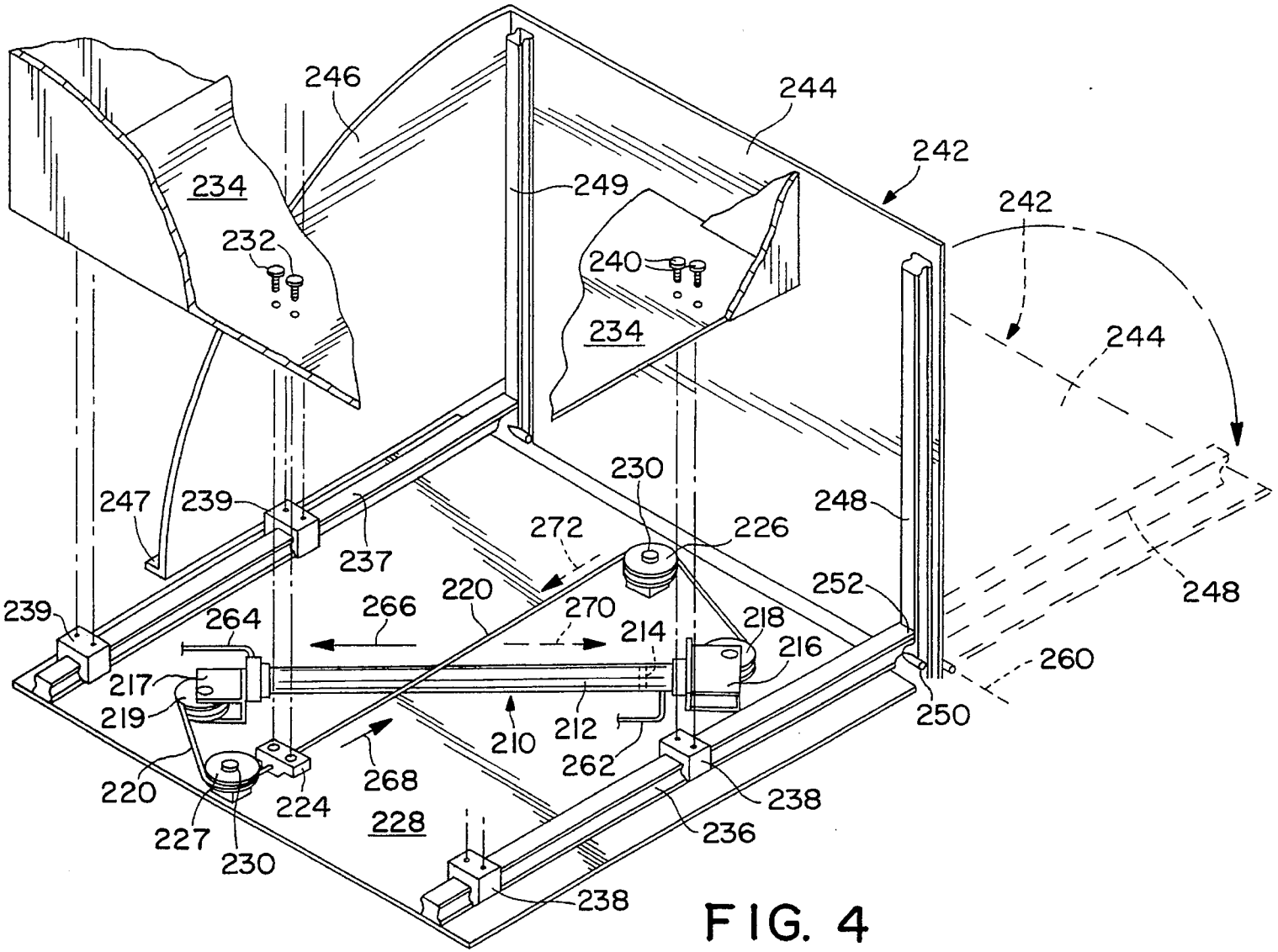
FIG. 4 is a perspective view, partially broken away, illustrating a second embodiment of the ATM module extension and retraction mechanism.

A second embodiment of the extending and retracting means is illustrated in FIG. 4. The extending and retracting means includes a cable cylinder 210 having a cylindrical body 212 and a piston 214 fitted therein so as to reciprocate along a longitudinal axis of cable cylinder 210. A cylinder pulley 218 is mounted to a pulley bracket 216 coupled to one end of cylindrical body 212. A cylinder pulley 219 is mounted to a pulley bracket 217 coupled to an opposite end of cylindrical body 212. Cable 220 is coupled at opposite ends to piston 214. Cable 220 is also coupled to a trolley 224. Cable cylinder 210 is illustratively a CABLE-TROL Model 05, 07 or 10 sold by Greenco Corporation of Dearborne, Mich. The particular model to be used is dictated by the specific application.

A pair of aligning pulleys 226, 227 rotate about pulley axles 230 and 231, respectively. Axles 230 and 231 are attached to base plate 228. Cable 220 extends between the two spaced apart aligning pulleys 226, 227. Cable cylinder 210 is aligned at an acute angle relative to an axis defined between aligning pulleys 226, 227. Cylinder pulley brackets 216, 217 are disposed so as to align cylinder pulleys 218, 219 with aligning pulleys 226, 227, respectively. Aligning pulleys 226, 227 are positioned above base plate 228 so as to lie in a plane above cable cylinder 210, thereby allowing cables 220 and trolley 224 to pass over cable cylinder 210.

The extending and retracting means further includes a pair of tracks 236 and 237 disposed in parallel, spaced-apart relation to each other and aligned parallel to the direction of motion of ATM module 12. Linear bearing blocks 238 and 239 are movably coupled to tracks 236 and 237, respectively. Blocks 238 and 239 are suitable fasteners such as bolts 240 to movable floor 234 of ATM module 12. Illustratively, tracks 236 and 237 and blocks 238 and 239 are a THK LM Guide Type HSR linear motion system available from THK America, Inc. of Elkgrove Village, Ill. The length of tracks 236 and 237 and number of blocks 238 and 239 used is dictated by the specific application.

A cabinet support member 242 rotates between an upright stowed position illustrated in FIG. 4, and a horizontal supporting position illustrated by dotted lines 242 in FIG. 4. Support member 242 pivots about an axis of rotation 260 which lies substantially parallel to the plane of base plate 228. In the stowed position, support plate 244 of support member 242 forms a portion of wall 14 located under the operator panel 58 of ATM 50. A pair of quarter-round side walls 246 are perpendicular to, and extend from, support plate 244 when support member 242 is in the stowed position. Each side wall 246 includes an outwardly extending flange 247. Flanges 247 perform the same functions as flanges 86 discussed above with reference to the embodiment of FIGS. 1–3.

Figure 5:
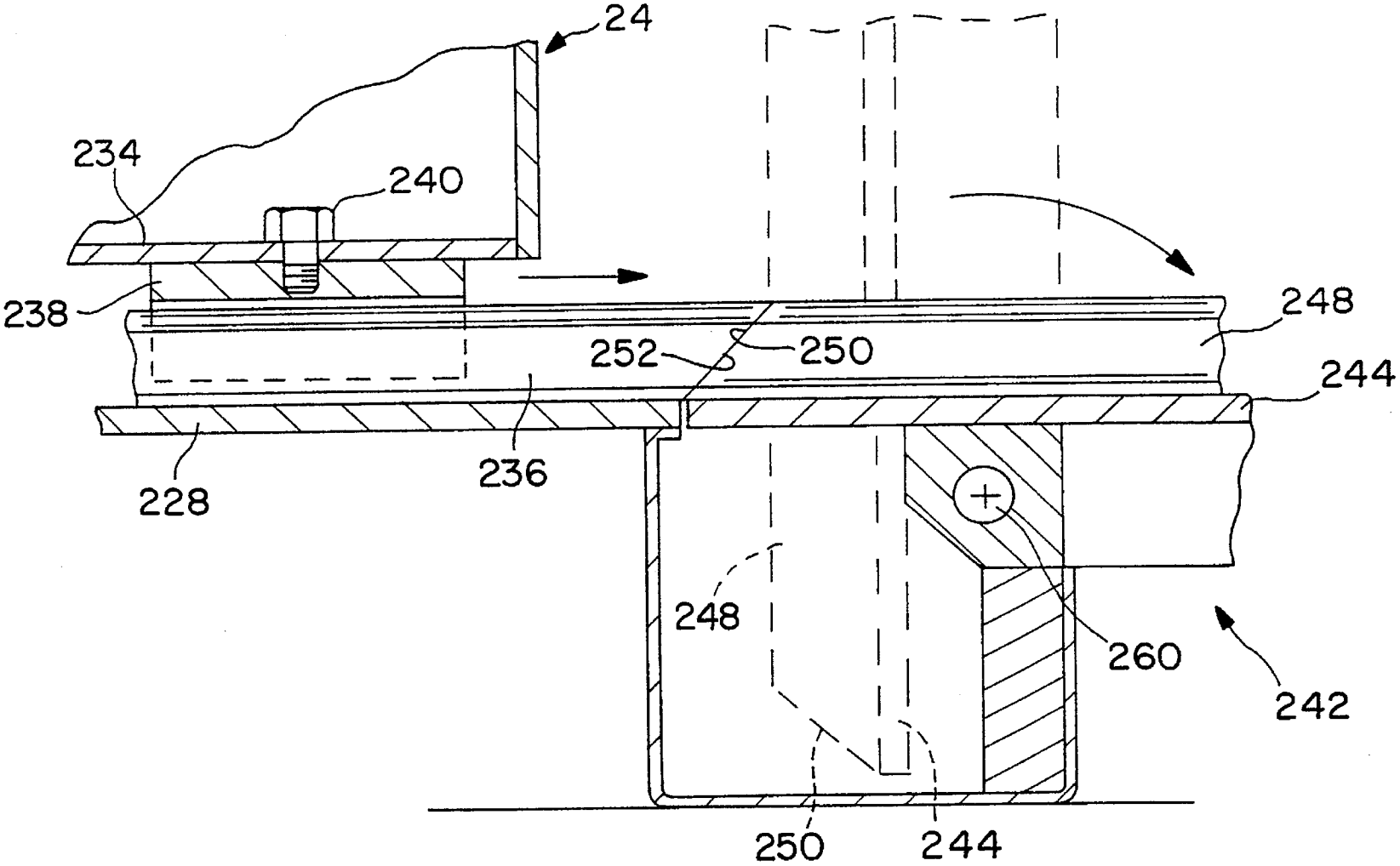
FIG. 5 is a sectional view illustrating a junction between an integral cabinet support member and a stationary base plate of the present invention illustrating the alignment of a pair of bearing tracks.

A pair of track extensions 248 and 249 are attached to support member 242. As best shown in FIG. 5, tracks 248 and 249 are aligned with tracks 236 and 237, respectively, when support member 242 is in the supporting position. Tracks 236 and 237 are formed to include a beveled notch 252 at an end of tracks 236 and 237 adjacent cabinet support member 242. A complementary beveled edge 250 is formed on an end of track extensions 248 and 249 so that when cabinet support member 242 is in the supporting position, tracks 236 and 237 cooperate with track extensions 248 and 249, respectively, to form a substantially continuous track upon which blocks 238 can move.

In operation, hydraulic pressure is applied through hydraulic lines 262 or 264 to move piston 214 within cylindrical body 212. As piston 214 moves within cylindrical body 212 in the direction of arrow 266, cable 220 attached to piston 214 moves in the direction of arrow 268. Cable 220 is attached to trolley 224. Movable floor 234 is coupled to trolley 224 by mounting bolts 232. Therefore, as trolley 224 moves in the direction of arrow 268, movable floor 234 and ATM module 12 also move in the direction of arrow 268, thereby extending ATM module 12. Movable floor 234 is supported by blocks 238 and 239 which slide over tracks 236 and 237, respectively.

To retract of ATM module 12, pressure is supplied through supply line 264 to move piston in the direction of arrow 270. This causes cable 220 and trolley 224 to move in the direction of arrow 272. Because trolley 224 is coupled to movable floor 234, trolley 224 pulls movable floor 234 and ATM module 12 back to the retracted position in the direction of arrow 272.

By providing a cable cylinder 210 positioned at an angle relative to the direction of motion of ATM module 12, and by using pulleys 218, 219, 226 and 227 attached to base 228 to align the direction of motion of cable 220 with the direction of motion of the ATM module 12, the present invention allows the-use a relatively large cable cylinder 210. A large cable cylinder 210 provides a longer extension than that which would be available from a conventional hydraulic cylinder illustrated in FIG. 3.

The embodiment of FIGS. 6–10 includes a manually operated mechanism for moving the ATM between the fully retracted and fully extended positions. The manually operated mechanism can be used independently as a sole or primary means of moving the ATM, or as a backup or secondary mechanism for use with a powered drive mechanism of a type similar to those described with reference to FIGS. 1–5. It will again be appreciated that elements shown in FIGS. 6–10 that are the same as those shown in FIGS. 1–5 have been identified with the same reference number.

Figure 7:
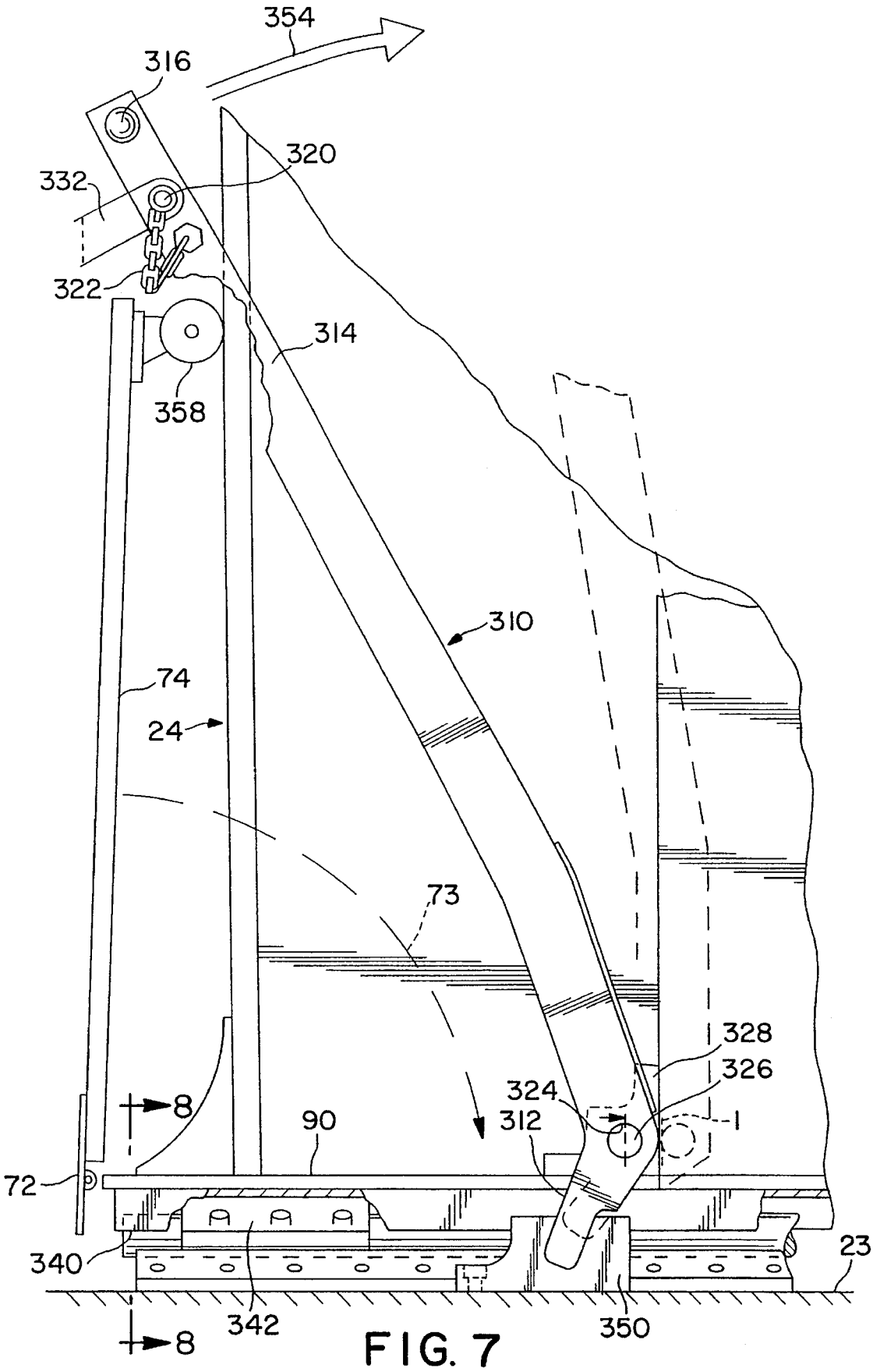
FIG. 7 is a partial side view of the ATM module as seen from the left in FIG. 6 showing the relative positioning of the bellcrank and an interference block when the ATM module is in the fully retracted position.
Figure 8:
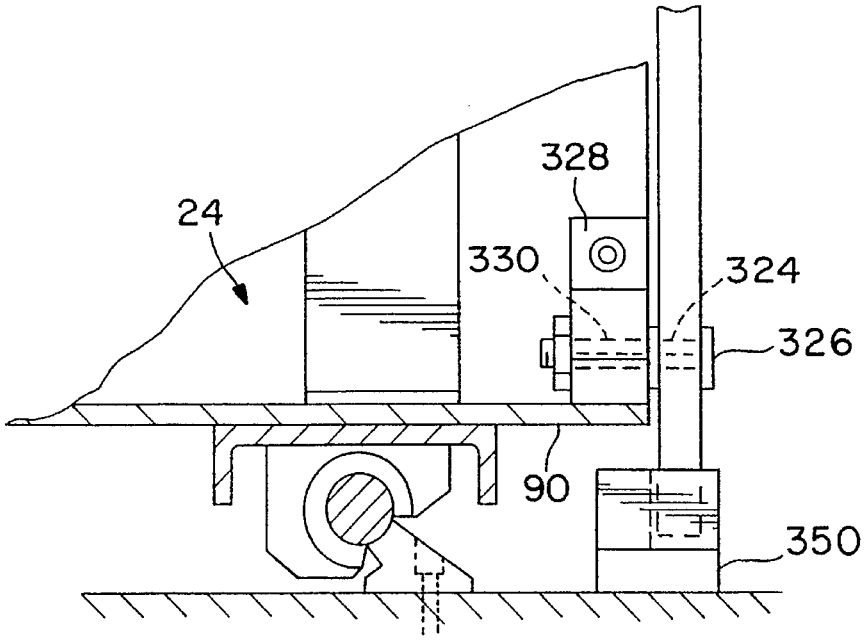
FIG. 8 is a sectional view taken along line 8—8 in FIG. 7 showing a support rail and ball bushings for supporting the ATM module.

As illustratively shown in FIG. 7, a bellcrank 310 is formed to include a short engaging portion 312, an elongated handle portion 314, and a handle 316 attached to the handle portion 314. A locking pin receiving aperture 318 (shown in FIG. 10) is formed adjacent the handle 316, and a locking pin 320 is attached by chain 322 to the elongated handle portion 314. A pivot pin receiving aperture 324 is formed in the bellcrank 310 at the juncture of the engaging portion 312 with the handle portion 314 to bearingly receive a pivot pin 326.

A mating block 328 is rigidly attached to the ATM module 24 and to the movable floor 90 and is formed to include a pivot pin receiving aperture 330 sized to bearingly receive the pivot pin 326. The bellcrank 310 is positioned alongside the mating block 328 so as to coaxially align the pivot pin receiving apertures 324, 330. The pivot pin 326 is journaled in the apertures 324, 330, thereby rotatably coupling the bellcrank 310 to the movable floor 90 and the ATM module 24.

A locking pin retaining bracket 332 includes a locking pin receiving aperture 334. Retaining bracket 332 is coupled to any suitable support 333. When the ATM module is in the fully retracted position, the locking pin receiving apertures 318, 334 are coaxially aligned to receive the locking pin 320, thereby locking the ATM module 24 in the fully retracted position.

The movable floor 90 is supported by a bearing mechanism that slidably couples the movable floor 90 to the base 22. A laterally offset, cylindrical support rail 340 is attached to the base 22. A ball bushing member 342 is rigidly attached to the movable floor 90 and slidably coupled to the support rail 340. A preferred type of support rail and ball bushing arrangement is the Ultra Ball Bushing Linear Bearing System sold by Thomson Industries, Inc., Port Washington, N.Y. As shown in greater detail in FIG. 8, the ball bushing member 342 extends perimetrally around the support rail 340 to encircle about three fourths of the circumference of the rail 340. Advantageously, the large perimetral extension of the ball bushing member 342 about the cylindrical rail 340 allows the bushing member 342 to support the movable floor 90 in a cantilevered position when the ATM module 24 is in the fully extended position. Thus, the need for any external or integral support is eliminated, thereby simplifying construction and reducing costs.

Figure 6:
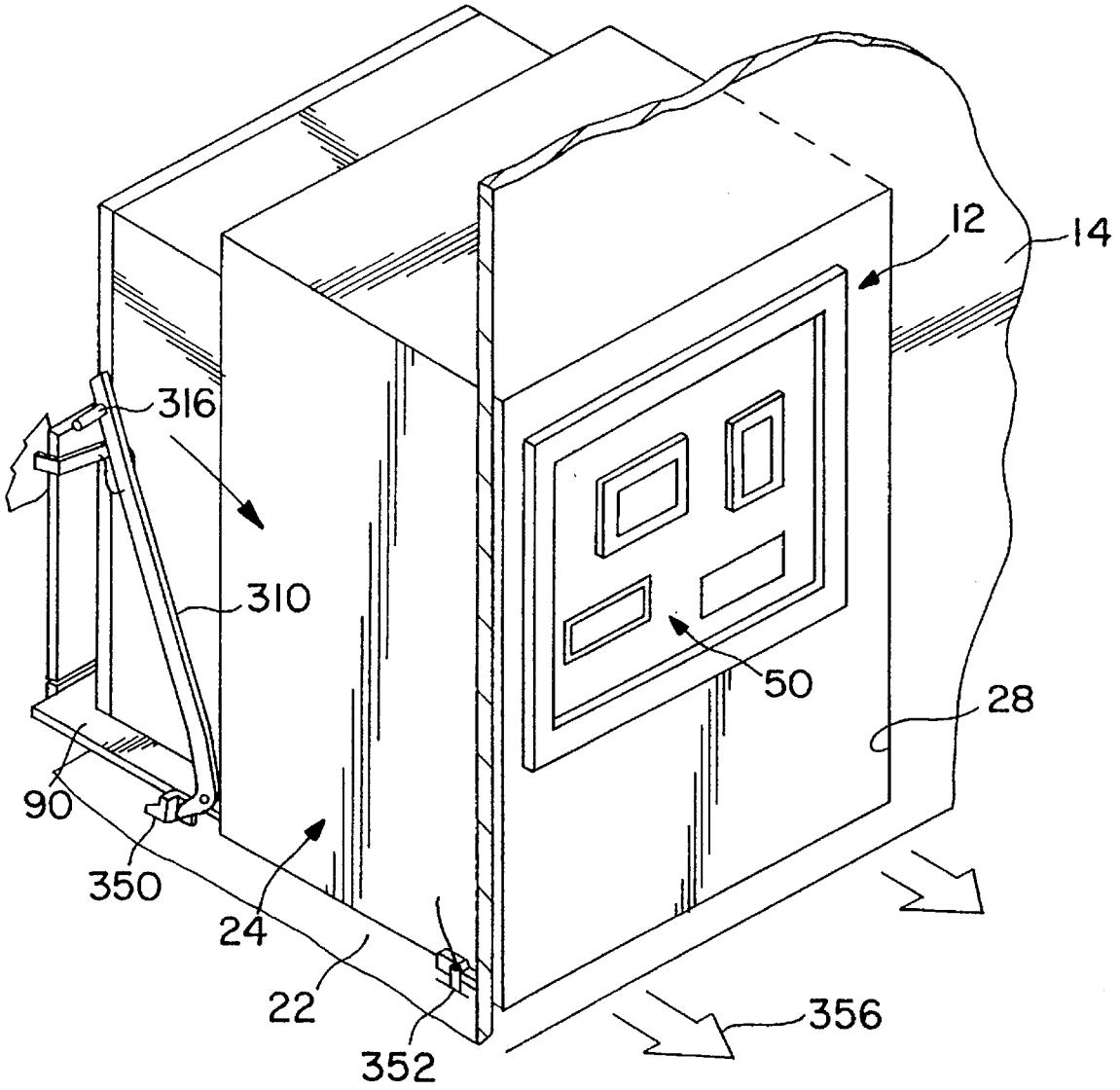
FIG. 6 is a perspective view of an ATM module in a fully retracted position and a bellcrank positioned to interfere with an interference block attached to the base to move the ATM module toward the fully extended position.

Interference blocks 350, 352 are rigidly attached to the base 22. The bellcrank 310 is positioned on the movable floor 90 so that movement of the bellcrank handle 316 in direction of arrow 354 causes the engaging portion 312 of the bellcrank 310 to contact the interference block 350. Continued movement of the bellcrank handle 316 in the direction of arrow 354 causes the engaging portion 312 of the bellcrank 310 to push against the interference block 350. An equal and opposite force is transmitted to the mating block 328 to move the ATM module 24 in the extending direction 356 (FIG. 6).

As the ATM module 24 extends, the floor cover plate 74 pivots about the hinge 72 in the direction of arrow 73 (FIG. 9), allowing rollers 358 (FIG. 10) to move along the back wall of the ATM module 24. When fully rotated, the floor cover plate 74 provides a working platform for the operator to stand on while resupplying or repairing the ATM 50.

Figure 9:
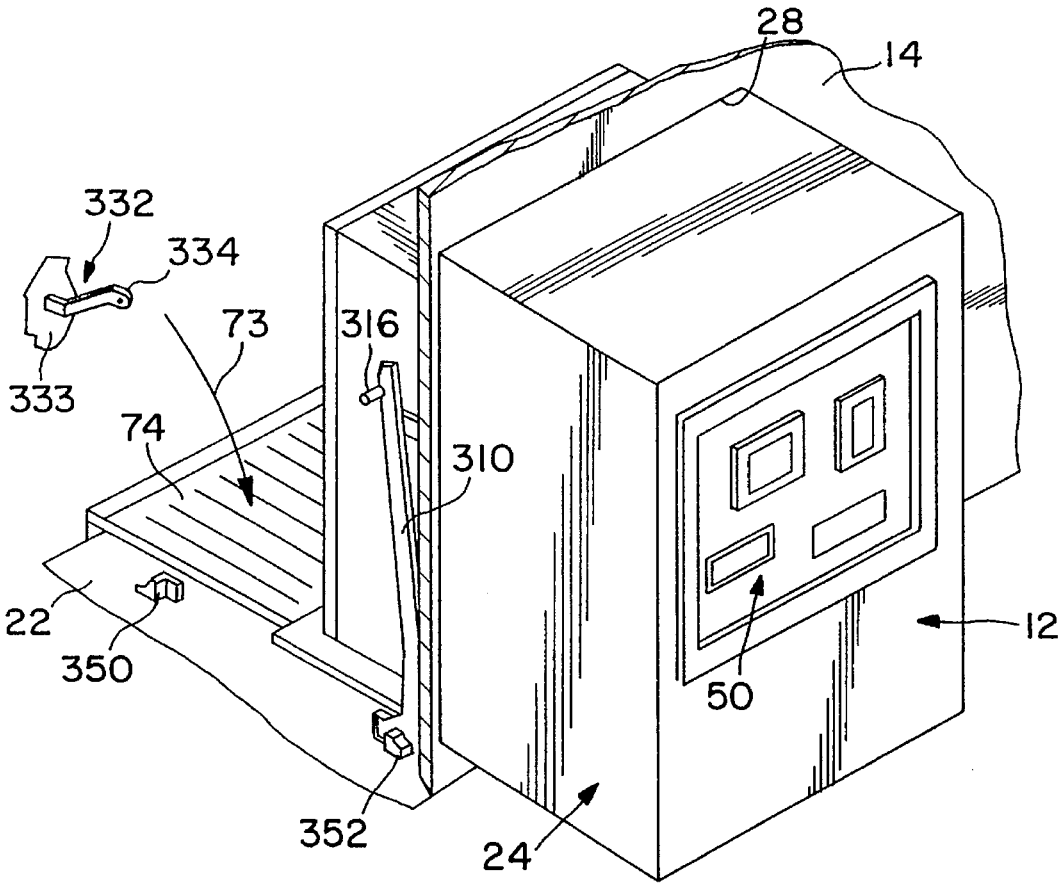
FIG. 9 is a perspective view of an ATM module in the fully extended position and a floor cover plate positioned to protect the support rail.

When the ATM module 24 has reached the fully extended position, as shown in FIG. 9, the bellcrank 310 contacts the interference block 352 which causes the bellcrank 310 to rotate about the pivot pin 326, striking the wall 14. Since the bellcrank 310 is unable to rotate further, the interference block 352, cooperating with the wall 14, stops the movement of the bellcrank 310 and the ATM module 24.

A locking pin retaining bracket 362 is attached to the wall 14 and includes a locking pin receiving aperture 364 (FIG. 9). The locking pin receiving apertures 318, 364 are coaxially aligned to receive the locking pin 320. When the locking pin 320 is journaled in the apertures 318, 364 the bellcrank is locked in position, thereby locking the ATM module in the fully extended position.

Figure 10:
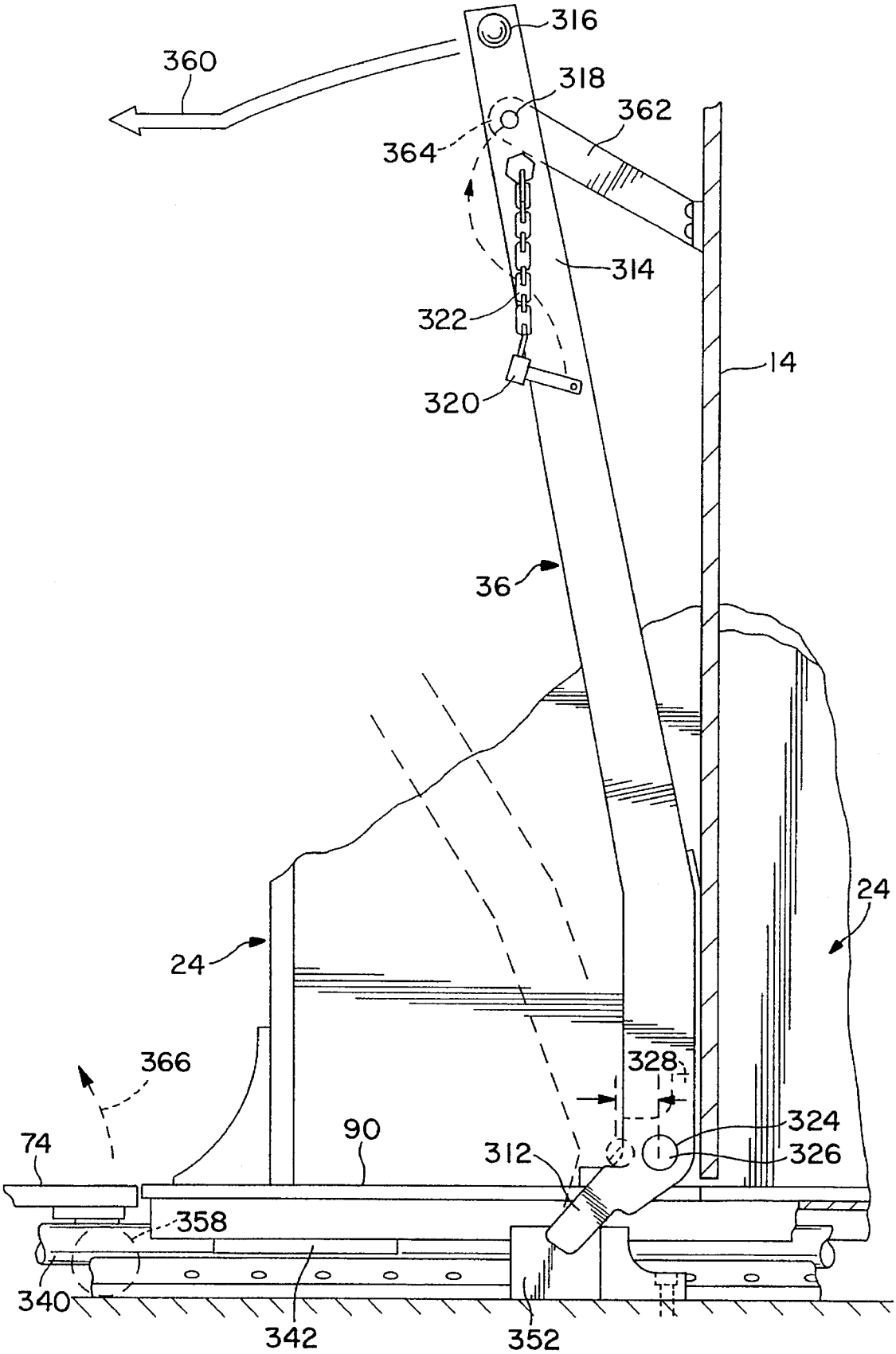
FIG. 10 is a partial side view of the ATM module as seen from the left in FIG. 6 showing the relative positioning of the bellcrank and an interference block when the ATM module is in the fully extended position.

To retract the ATM module 24, the operator removes the locking pin 320 from the apertures 318, 364, rotates the floor cover plate 74 in the direction of arrow 366 (FIG. 10) to the stowed position (FIGS. 6 and 10), and moves the handle in the direction of arrow 360 (FIG. 10). In a preferred embodiment, a ramp is formed on the back of the ATM module 24 to cam the rollers 358 up the back of the ATM module 24, thereby automatically rotating the floor cover plate 74 into the stowed position and avoiding the need for the operator to manually rotate the floor cover plate 74.

Movement of the handle 316 in the direction of arrow 360 (FIG. 10) causes the engaging portion 312 to push against the interference block 352. An equal and opposite force is transmitted to the pivot pin 326 to move the ATM module 24 in the retracting direction opposite to arrow 356.

Figure 12:
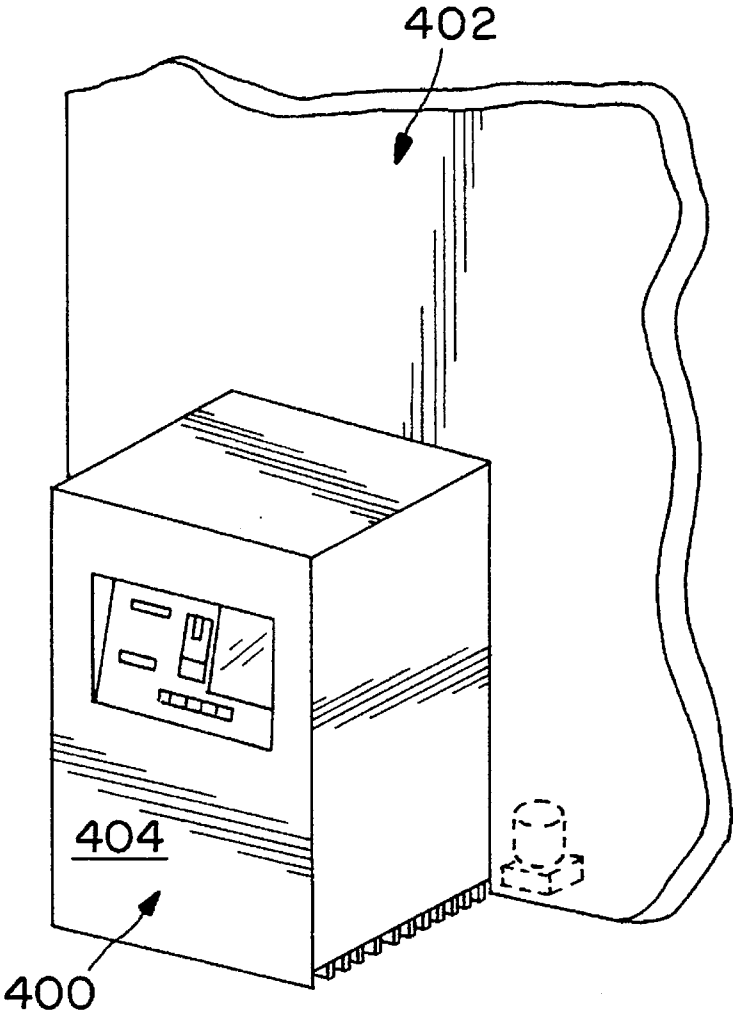
FIG. 12 is a perspective similar to FIG. 1 illustrating the ATM module in an extended position.
Figure 11:
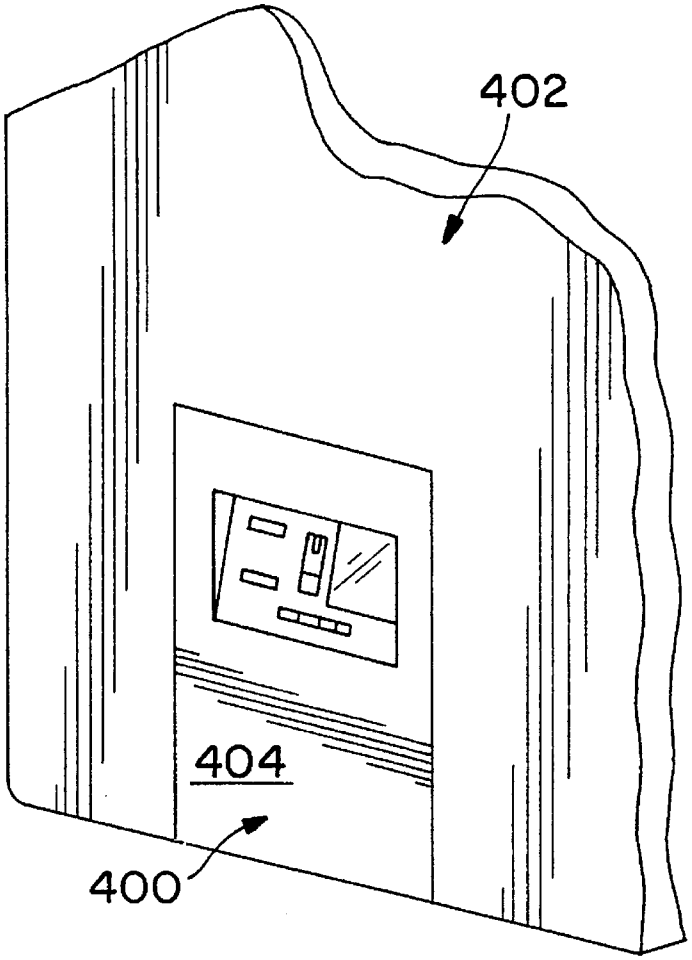
FIG. 11 is a perspective view of a wall having an extendable ATM module of the present invention located therein in a retracted position.

Another embodiment of the present invention is illustrated in FIGS. 11–16. FIG. 11 illustrates an ATM module 400 located in a retracted position within a wall 402 so that a front panel 404 of ATM 400 is aligned with an outer surface of wall 402 during normal operation of ATM 400. FIG. 12 illustrates ATM 400 in an extended position to permit servicing of ATM 400. In its extended position illustrated in FIG. 12, front panel 404 of ATM 400 is extended outwardly beyond the outer surface of wall 402.

Figure 13:
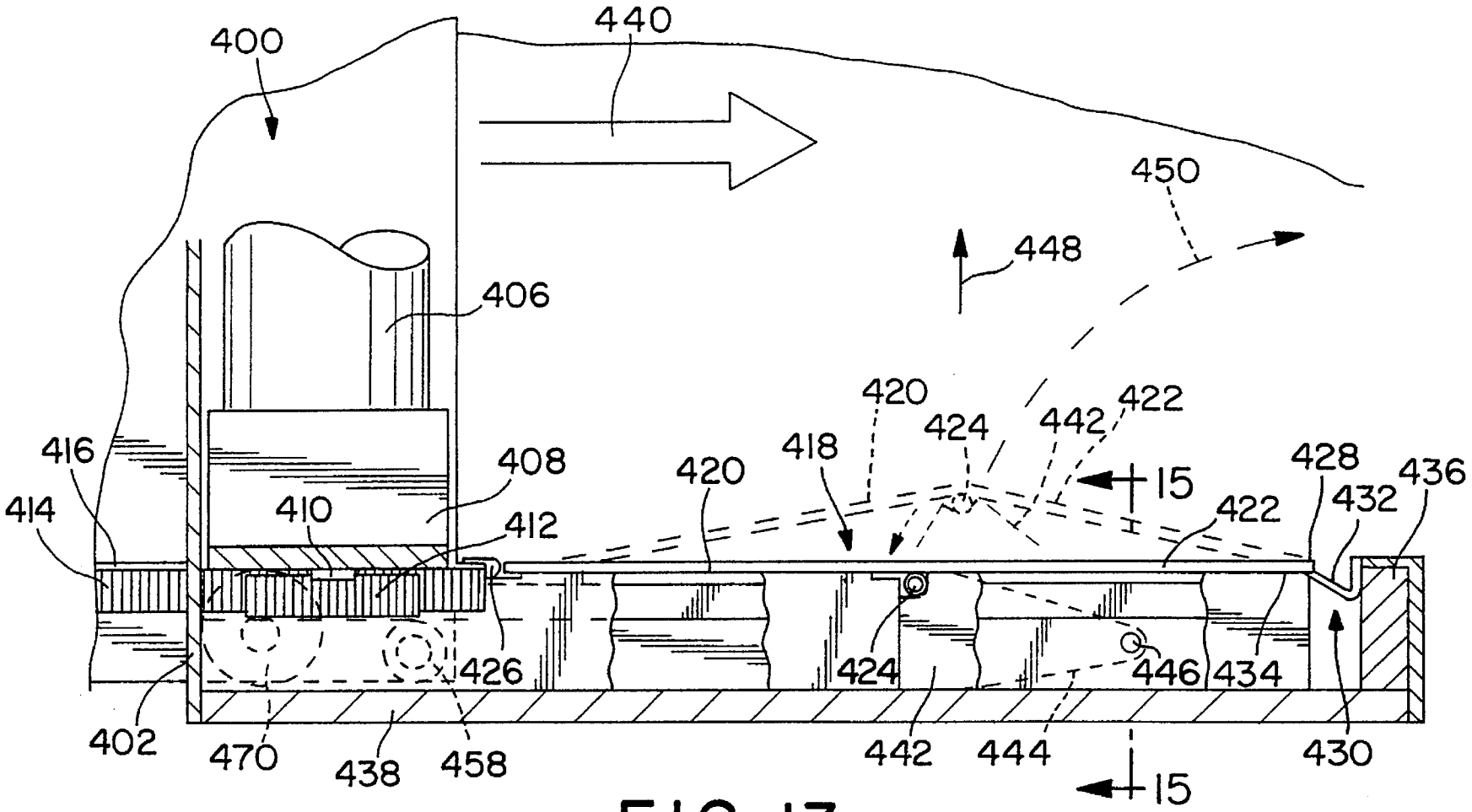
FIG. 13 is a sectional view of the ATM module in its extended position illustrating operation of a folding floor panel as the ATM module moves from its extended position to its retracted position.

FIG. 13 is a sectional view illustrating ATM 400 in its extended position. An electric motor 406 coupled to gear box 408 rotates a drive shaft 410 which is rotatably coupled to a base 438. A round gear 412 having a plurality of teeth is configured to engage a toothed rack 414 mounted to a base plate 416 of ATM 400. Motor 406 rotates gear 412 in opposite directions so that gear 412 engages rack 414 to move ATM 400 between its retracted position illustrated in FIG. 11 and its extended position illustrated in FIG. 12. In this embodiment, gear 412 directly engages means coupled to ATM 400. This direct engagement of gear 412 and rack 414 facilitates movement of ATM 400 relative to base 438 compared to conventional chain and sprocket drive mechanisms. It is understood that other motor drive gear arrangements in which the gear directly engages means coupled to ATM 400 may be used in connection with the present invention.

A foldable floor panel 418 includes a front panel section 420 and a rear panel section 422. Front panel section 420 is pivotably coupled to rear panel section 422 by a pair of hinges 424 located beneath foldable floor panel 418. Front panel section 420 is also pivotably coupled to base plate 416 of ATM 400 by a hinge 426. An end 428 of rear panel section 422 is free floating. End 428 rests on a support rail 430 including a trough portion 432 and an extended ledge 434. In other words, end 428 is not coupled to support rail 430. Support rail 430 is coupled to a support 436 which is, in turn, coupled to nonmovable base 438. FIG. 13 illustrates foldable floor panel 418 in its unfolded, generally planar or horizontal position. In the planar or horizontal position of FIG. 13, floor 418 provides a support surface for a worker to load or repair ATM 400.

Figure 15:
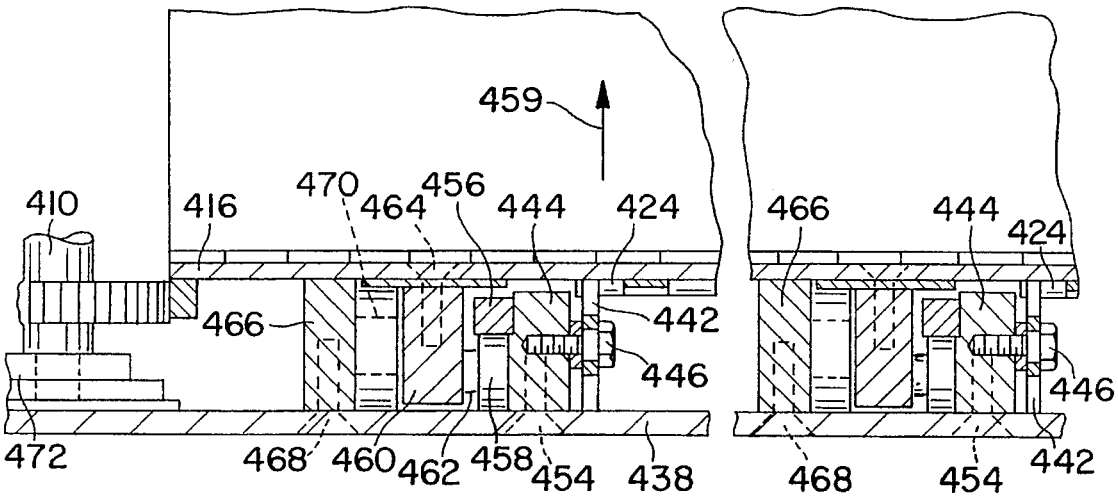
FIG. 15 is a sectional view taken along lines 15—15 of FIG. 13.

When electric motor 406 is actuated to move ATM 400 in the direction of arrow 440, a cam 442 engages hinge 424 of foldable floor panel 418. Cam 442 is pivotably coupled to a support rail 444 by a suitable fastener 446. As illustrated in FIG. 15, two such cams 442 are provided. When hinges 424 engage cams 442, cams 442 pivot to the dotted position of FIG. 13 as ATM 400 moves in the direction of 440. Therefore cams 442 automatically lift foldable floor panel 418 upwardly in the direction of arrow 448 to the dotted positions of FIG. 13 so that foldable floor panel 418 can fold as ATM 400 moves from its extended position to its retracted position. Once cams 442 lift foldable floor panel 418 to the dotted position illustrated in FIG. 13, cams 442 automatically fall away from floor panel 418 and return to the position illustrated in FIG. 13.

Figure 14:
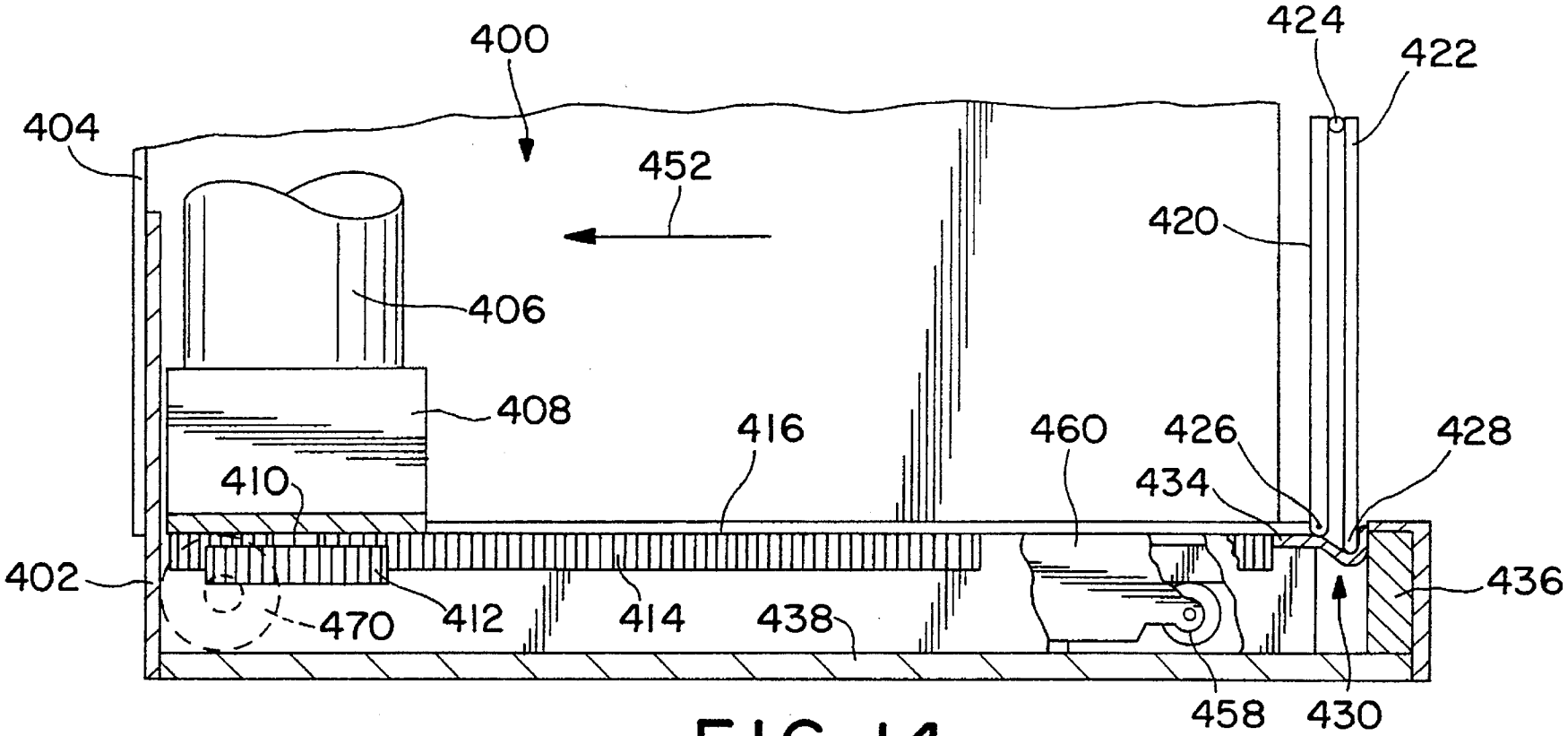
FIG. 14 is a sectional view similar to FIG. 13 illustrating the ATM module in its retracted position.

As ATM 400 continues to move in the direction of arrow 440, front panel section 420 and rear panel section 422 continue to pivot about hinges 426 and 424 so that rear panel 422 folds upwardly in the direction of arrow 450. FIG. 14 illustrates the configuration of ATM 400 in its folded, generally upright position. Foldable floor panel 418 therefore does not block movement of ATM 400 to its retracted position. Front wall 402, base 438, and electric motor 406 do not change positions as ATM 400 moves. When foldable floor panel 418 is in its folded orientation, end 428 of rear panel section 422 is nested in trough 432 of support rail 430.

When motor 406 is actuated to move ATM 400 in the direction of arrow 452 in FIG. 14 toward its extended position, end 428 is free to float or move relative to support rail 430. Therefore, tolerance is provided to permit ATM 400 to move to a different position relative to front wall 402 without straining drive shaft 410, gear 412, or motor 406.

FIG. 15 illustrates the support rails and bearings which facilitate movement of ATM 400 relative to front wall 402. Identical numbers have been placed on identical components of the support rails and bearings. One set of support rails and bearings is located adjacent each side of ATM 400. As discussed above, cams 442 are pivotably coupled to support rails 444 by fasteners 446. FIG. 15 illustrates a pair of hinges 424 which couple front panel section 420 to rear panel section 422. Each support rail 444 is coupled to base 438 by a suitable fastener 454. A pair of guide rails 456 are rigidly coupled to support rail 444 to define a guide track between guide rail 456 and base 438 for receiving a bearing 458 therein. Bearing 458 is rotatably coupled to a support bar 460 by shaft 462. Support bar 460 is rigidly coupled to base plate 416 of ATM 400 by a suitable fastener 464. Therefore, bearing 458 moves along with ATM 400 when ATM 400 moves relative to front wall 402. Guide rails 456 block movement of bearings 458 in the direction of arrow 459. This prevents ATM 400 from tipping when ATM 400 is in its extended position.

Another pair of support rails 466 are coupled to base 438 by suitable fasteners 468. A bearing 470 is rotatably coupled to each support rail 466. As illustrated in FIG. 14, bearings 470 are located near front wall 402. The position of bearings 470 does not change relative to front wall 402 as ATM 400 moves relative to front wall 402. FIG. 15 also illustrates that drive shaft 410 is rotatably coupled to base 438 by suitable bearings 472.

Figure 16:
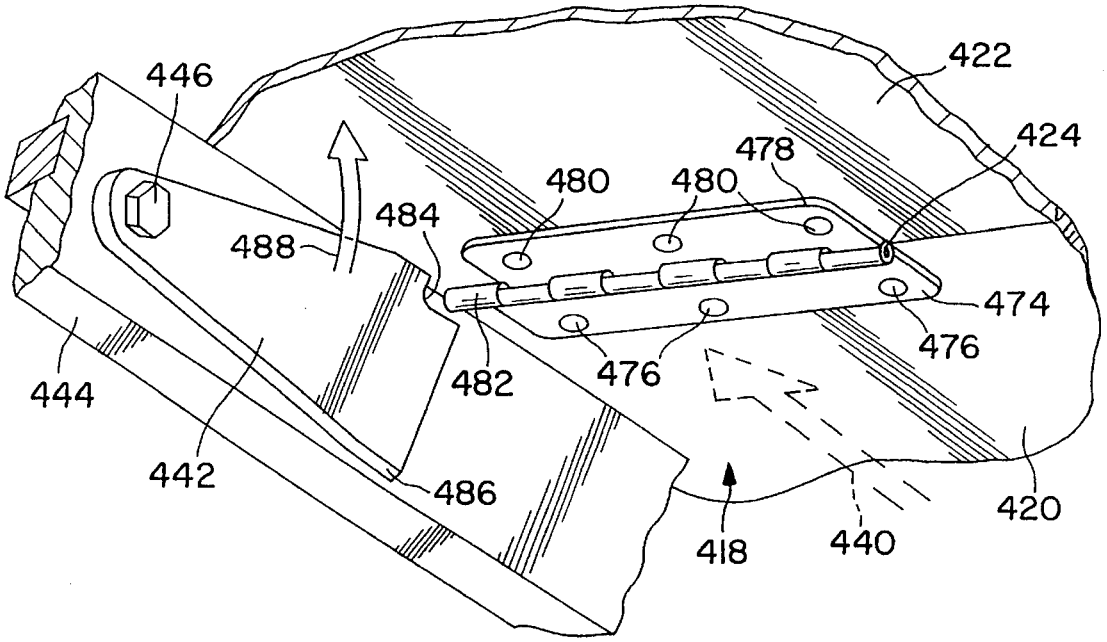
FIG. 16 is a perspective view illustrating a cam for automatically folding the floor panel as the ATM module moves from its extended position to its retracted position.

FIG. 16 illustrates the configuration and operation of one of the cams 442 of the present invention. Hinge 424 includes a first section 474 coupled to front panel 420 by fasteners 476 and a second section 478 coupled to rear panel 422 by fasteners 480. An extended section 482 is configured to engage a notch 484 formed in cam 442 as foldable floor panel 418 moves in the direction of arrow 440 relative to support rail 444 which is rigidly coupled to base 438. A bottom edge 486 of cam 442 rests against base 438. Since the location of the pivot fastener 446 is spaced below the location at which extended portion 482 engages notched section 484, cam 442 rotates in the direction of arrow 488 as foldable floor panel 418 continues to move in the direction of arrow 440. This movement of cam 442 causes foldable floor panel 418 to move to the dotted position illustrated in FIG. 13. After the foldable floor panel is lifted a predetermined distance by cam 442, cam 442 falls away from floor panel 418 and returns to the position illustrated in FIGS. 13, 15, and 16. Therefore, cam 442 cooperates with extended portion 482 of hinge 424 to provide means for automatically lifting foldable floor panel 418 as ATM 400 moves from its extended position to its retracted position. This permits foldable floor 418 to move from its unfolded generally planar orientation illustrated in FIG. 13 to its folded, upright orientation illustrated in FIG. 14. Cams 442 also include an inclined ramp surface 490. Ramp surfaces 490 of cams 442 permit extended sections 482 of hinges 424 to move over cams 442 without engaging the cams 442. Therefore, foldable floor panel 418 is free to move over cams 442 when ATM moves from its retracted position to its extended position.

It is understood that the moving means illustrated in FIGS. 13–15 which includes the drive shaft 410, gear 412, and rack 414 may also be used with the other embodiments of the present invention illustrated in FIGS. 1–10. Foldable floor panel 418 may also be used with the other embodiments of the present invention illustrated in FIGS. 1–10 if desired.

Although the invention has been described in detail with reference to a preferred embodiment and specific examples, variations and modifications exist within the spirit and scope of the invention as described and defined in the following claims.

What is claimed is:

1. An apparatus for moving an ATM relative to a wall between a retracted position and an extended position, the apparatus comprising:

a base;

a support for holding the ATM;

a cable fixedly secured at both ends and with one end fixedly secured to the support;

said cable extended in a first straight line from one of its fixed ends, wrapped about a rotating pulley from whence the cable extends in a straight line directly to its other fixed end and wherein the cable only has its direction changed once as it is wrapped about the rotating pulley; and a drive mechanism coupled to the base and to the cable, the drive mechanism when activated in a first direction causing the cable to move around the rotating pulley so as to move the end of the cable fixedly secured to the support closer to the pulley to move the ATM between its retracted position and its extended position.

2. The apparatus of claim 1, further comprising a bearing positioned between the base and the support to carry the support and facilitate movement of the support and the ATM relative to the base.

3. The apparatus of claim 2, wherein the bearing assembly is configured to permit movement of the support and the ATM between the retracted position and the extended position; and wherein the support is cantilevered from the base.

4. The apparatus of claim 1, wherein the cable is coupled to the support at a location located below the ATM to facilitate movement of the support holding the ATM relative to the base.

5. The apparatus of claim 1 wherein another end of the cable is fixedly secured to the base.

6. The apparatus of claim 1 wherein a separate cable and drive mechanism is provided for retraction of the support and ATM into is retracted position.

7. The apparatus of claim 6 wherein the separate drive mechanism includes a moveable pulley around which the separate cable extends and with the ends of the cable being fixed and with one end being fixed to the base so that the cable rotates about the pulley to shorten the distance between the one end of the cable fixed to the base and the rotating pulley as the support and ATM are moved to the retracted position.

8. An apparatus for moving an ATM relative to a wall between a retracted position and an extended position, the apparatus comprising:

a base;

a support for holding the ATM resting atop the base in retracted position;

a drive mechanism coupled to the base and to the support, the drive mechanism moving the support outwardly relative to the wall to move the ATM between its retracted position and its extended position; and a bearing assembly located between the base and the support, the bearing assembly carrying the support on the base while permitting movement of the support and the ATM, between the retracted position atop the base to the extended position, wherein a portion of the support extends beyond the base in a cantilevered position.

9. The apparatus of claim 8, wherein the drive mechanism includes a cable coupled to the support, the drive mechanism being configured to move the cable relative to the base, thereby moving the support holding the ATM between its retracted position and its extended position.

10. The apparatus of claim 9, wherein the drive mechanism includes at least one rotating pulley for guiding the cable.

11. The apparatus of claim 9, wherein the support includes a top surface for holding the ATM, the cable being coupled to the support at a location located below the top surface.

12. An apparatus for moving an ATM relative to a wall between an extended position and a retracted position, the apparatus comprising:

a base;

a support for holding the ATM;

a cable fixedly attached at both ends to the base;

a drive mechanism on the support including a rotating pulley having the cable wound thereabout, the drive mechanism moving the rotating pulley to cause a portion of the cable to move relative to the base to move the ATM between its extended position and its retracted position; and a bearing assembly positioned between the base and the support to facilitate movement of the support and the ATM relative to the base, the bearing assembly being configured to permit movement of the support and the ATM between the retracted position and the extended position wherein the support is cantilevered from the base.

* * * * *